US005216853A

United States Patent [19]

Dignan et al.

[11] Patent Number: 5,216,853

[45] Date of Patent: Jun. 8, 1993

[54] TELEPHONE ENCLOSURE

[75] Inventors: Kenneth F. Dignan, Bakersfield; Alfred C. Scywegler, San Jose, both of Calif.

[73] Assignee: Pacific Bell, San Francisco, Calif.

[21] Appl. No.: 551,935

[22] Filed: Jul. 12, 1990

[51] Int. Cl.[5] ..... E04H 1/14

[52] U.S. Cl. ..... 52/27; 52/264; 52/36.1

[58] Field of Search ..... 52/264, 27, 36

[56] References Cited

U.S. PATENT DOCUMENTS

| | | | |
|---|---|---|---|
| D. 223,815 | 6/1972 | Ericsson et al. | 52/27 |
| 822,493 | 6/1906 | Turner | 52/264 |
| 2,302,106 | 11/1942 | Corso | 52/36 |
| 4,152,874 | 5/1979 | Ertl | 52/27 |
| 4,241,806 | 12/1980 | Metzger | 181/284 |
| 4,754,582 | 7/1988 | Cameron | 52/27 |
| 4,918,878 | 4/1990 | Paschke et al. | 52/27 |

*Primary Examiner*—Richard E. Chilcot, Jr.
*Assistant Examiner*—Joanne C. Downs
*Attorney, Agent, or Firm*—McCubbrey, Bartels, Meyer & Ward

[57] ABSTRACT

A telephone enclosure which provides wheelchair access while maintaining efficient usage of floor space is disclosed. The enclosure includes two telephone instruments. The enclosure may be constructed from mass-produced components while providing an appearance that can be customized for a particular business establishment.

6 Claims, 1 Drawing Sheet

TELEPHONE ENCLOSURE

BACKGROUND OF THE INVENTION

The present invention relates to telephone enclosures, and more particularly to a telephone enclosure which provides wheelchair access for the handicapped while maintaining efficiency of space.

Enclosures containing public telephones, commonly referred to as telephone booths, have long been available in public places and in business establishments for use by patrons of these establishments and by the general public. The booths are often outside in prominent locations. In general, the telephone booths are provided by the business. However, the booth usually bears only the logo of the telephone company providing the telephone service. As a result, the telephone user does not associate the telephone booth and the service it provides with the business. The appearance of two separate business on the premises, the telephone company and the business owner's, tend to detract from the business premises. Hence, it would be advantageous to provide a telephone booth that appears to be an integral part of the business establishment.

Unfortunately, the market for telephone booths for any given business establishment or chain of establishments is too small to allow custom booths to be manufactured for each business. Accordingly, it would be advantageous to provide a telephone booth which could be economically customized to reflect a particular business establishment.

Efficient use of space is of primary importance both in public places and in business establishments. Hence, the emphasis in telephone booth design has traditionally been the fulfillment of the specified function while encompassing a minimum amount of floor space. Typical telephone booth installations consist of a number of telephones, housed side by side in small booths or lesser enclosures. The number of telephones is selected to accommodate the anticipated peak load. At other times, most of the telephones are unused. Hence, it would be advantageous to provide a telephone booth which serves other functions when it is not in use. In this regard, the use of the booth as a vehicle for advertising the products of the business establishment would be particularly useful.

Prior art telephone enclosures are also deficient in that they are not accessible to handicapped persons confined to wheelchairs. These prior art telephone booths normally have accordion doors which, when completely open, provide an access port that is only 30" wide. This is insufficient for a wheelchair to enter. To make matters even worse, these accordion doors normally slide in a slotted track mounted at the top and at the foot of the door opening, making it difficult or impossible for a wheelchair to pass over the door sill.

Even if a wheelchair could pass through the door, the telephones are normally placed too high to allow a handicapped person seated in a wheelchair to reach the coin slots or to dial the phone. Furthermore, telephone booths usually have a rack of telephone directories mounted beneath the counter below the telephone. A wheelchair occupant is typically obstructed by the placement of this rack from moving the wheelchair close enough to the telephone to gain access to the phone.

One prior art solution to the problem of handicapped access has been to construct special telephone booths.

The booths in question are wide enough to accommodate wheelchairs and have telephone instruments which are lower to the ground. Unfortunately, these booths require significantly more floor space per telephone. As pointed out above, floor space is at a premium in most establishments.

Broadly, it is an object of the present invention to provide an improved telephone enclosure.

It is another object of the present invention to provide a telephone booth that can be mass-produced and then be customized to provide an appearance that associates it with a given business enterprise.

It is a still further object of the present invention to provide a telephone booth that may be used for advertising the products of the business establishment in which it is placed.

It is yet another object of the present invention to provide a telephone enclosure which permits access to persons confined to wheelchairs.

It is a still further object of the present invention to provide a wheelchair-accessible telephone enclosure which maintains efficient utilization of floor space.

These and other objects of the present invention will become apparent to those skilled in the art from the following detailed description of the invention and the accompanying drawings.

SUMMARY OF THE INVENTION

The present invention comprises a telephone enclosure which provides convenient wheelchair access for handicapped users. The enclosure has an entry which is sufficiently wide to accommodate a wheel chair. The telephone booth includes two telephones, mounted at a height which permits access to the coin slots, receiver, and dialing pad by a person seated in a wheelchair. The preferred embodiment of the present invention includes a counter mounted immediately below each telephone. Beneath the counter under the right-hand of the two telephones in the enclosure is mounted a rack of telephone directories. The area beneath the counter under the left-hand phone is empty, permitting a wheelchair to be moved in as close as desired to the telephone.

The two telephones in the enclosure are maximally spaced along a soundproofed wall, mounted at angles that provide reasonable privacy, permitting the telephone enclosure of the present invention to be utilized by two persons simultaneously when the enclosure is not being used by a handicapped person in a wheelchair. Thus, the floor space occupied by the telephone enclosure of the present invention is no greater than that occupied by two conventional single-user enclosures, and, in addition to providing facilities for two single users, provides access for a handicapped user confined to a wheelchair.

One embodiment of the telephone enclosure of the present invention includes three removable panels on each side of the enclosure for displaying a logo or some other indentifying information for the business or premises owner, as well as for displaying advertising placards.

DETAILED DESCRIPTION OF THE INVENTION

Figure 3:
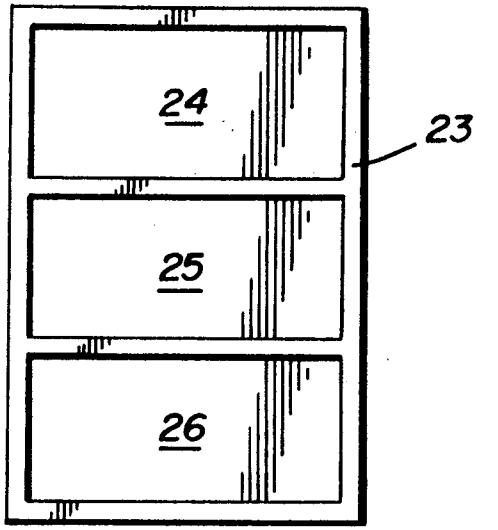
FIG. 3 is a side view of a telephone booth according to the present invention.
Figure 2:
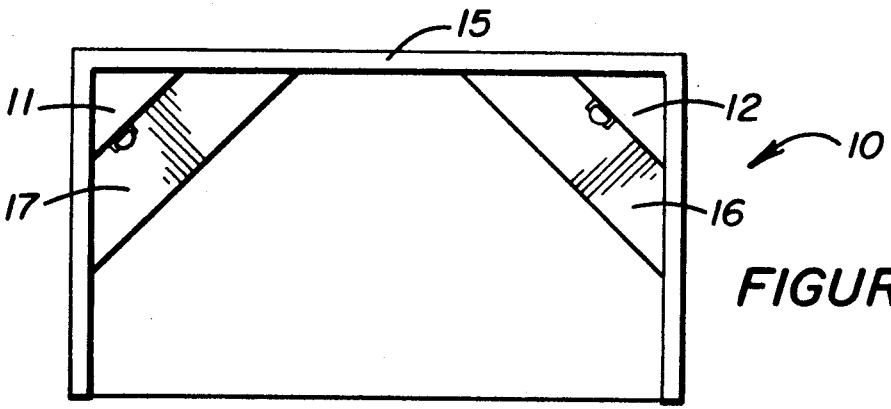
FIG. 2 is a top view of a telephone booth according to the present invention.
Figure 1:
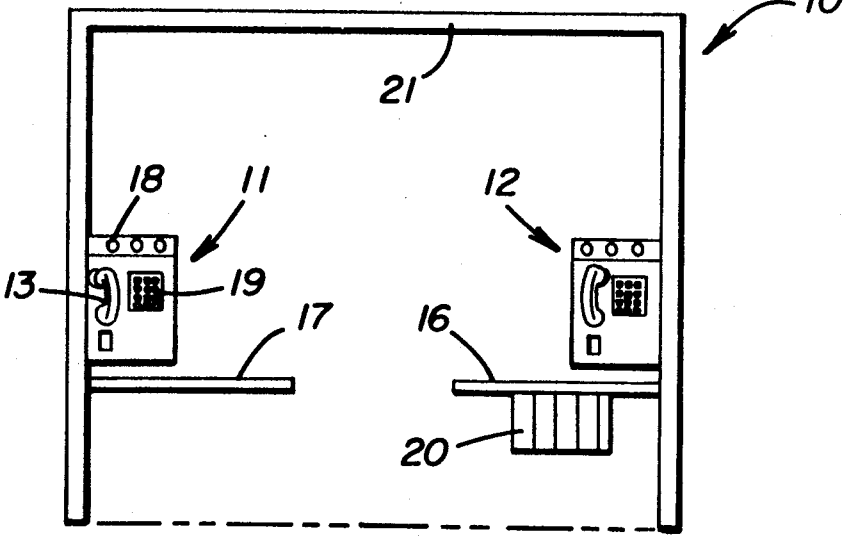
FIG. 1 is a front view of a telephone booth according to the present invention.

The present invention may be most easily understood with reference to FIGS. 1, 2, and 3. FIG. 1 is a front view of a telephone enclosure 10 according to the present invention. FIG. 2 is a top view of an enclosure 10, and FIG. 3 is a side view of telephone enclosure 10. The entrance 14 to the enclosure, indicated as a broken line in the figures, is preferably 5' wide, permitting easy access to the enclosure by a handicapped person confined to a wheelchair. The bottom sill of the door opening is flush with the surrounding floor area, so as not to impede wheelchair access.

Telephone enclosure 10 has two telephone instruments, 11 and 12, mounted angularly against the back wall of the enclosure. These telephones are mounted such that the coin slots 18 on each instrument are located at a height of approximately 52" from the floor of the enclosure. Thus, the coins slots 18, the receiver 13, and the dialing pad 19 on each instrument are easily accessible to a person either seated in a wheelchair or standing in front of the telephone.

As shown in FIG. 1, there is a rack 20 for holding telephone directories mounted beneath counter 16 below telephone 12, the right-hand instrument in the enclosure. There is no such rack beneath counter 17 below telephone 11, the left-hand instrument. The lack of obstructions under the left-hand instrument provides improved access to the left-hand instrument for persons in wheel-chairs. Yet the directories are available in the enclosure, within easy reach, should a handicapped user need access to them. The left-hand instrument was chosen because most persons are right handed.

The telephone instruments are mounted against the rear wall 15 of the enclosure, at 45° angles with respect to the rear wall, as indicated at 11 and 12 in FIG. 2. This arrangement provides maximum distance between the two instruments. The rear wall 15 of the enclosure comprises a soundproofing material, which, in conjunction with the spacing of the instruments, insures reasonable privacy when two users are sharing the booth.

By providing access for two non-handicapped users when the booth is not being used by a handicapped person, the present invention provides more efficient utilization of floor space then would be available if one handicapped accessible booth and one standard booth were used. Hence, the present invention provides a means for a business establishment to provide handicapped access to telephones without losing floor space. In most instances, the booth will be used by two non-handicapped users. Hence, the effective loss of capacity is small.

The two side walls of telephone enclosure 10 are preferably constructed from steel frameworks 23, as shown in FIG. 3. Each such framework 23 is designed to hold three panels 24–26 which are inserted at a late stage in the fabrication process. In the preferred embodiment of the present invention, the panels may be viewed from both inside and outside the telephone enclosure.

These panels may be customized to provide a customized appearance which the user associates with the particular business establishment in which the enclosure is located. Hence, the manufacturer need only stock one type of framework. Panels 24–26 can be provided for different businesses at a moderate cost. For example, the panels may constructed from vacuum formed plastic bearing the business logo. Thus, the present invention provides the economies of scale associated with one mass-produced set of components while providing a customizable appearance for each establishment.

In the preferred embodiment of the present invention, panel 24 carries a logo associated with the business, and panel 26 carries a logo associated with the telephone company.

The third panel 25 preferably comprises a lockable transparent window adapted for displaying advertising material. This arrangement provides a means for quickly replacing the advertising material while securing the same from vandalism.

While the present invention has been described with reference to two telephone instruments mounted at a height compatible with wheelchair access, it will be apparent to those skilled in the art that only one of the instruments need be mounted at this height.

There has been described herein a telephone enclosure. Various modifications to the present invention will become apparent to those skilled in the art from the foregoing description and accompanying drawings. Accordingly, the present invention is to be limited solely by the scope of the following claims.

What is claimed is:

1. A telephone enclosure comprising:

a booth comprising three walls, said walls being a left sidewall, a right sidewall, and a backwall, said left and right sidewalls being parallel to each other, said walls being aligned to correspond to three of the sides of a quadrilateral, and further comprising a roof;

an entrance doorway adapted for wheelchair access, said entrance doorway aligned to correspond to the fourth side of said quadrilateral, said entrance doorway being of sufficient width to allow entrance and egress by a wheelchair;

a first pay telephone instrument mounted in a manner accessible to a user in a wheelchair;

a second pay telephone instrument spaced apart from said first telephone instrument by a distance sufficient to allow said first and second telephone instruments to be used simultaneously by two non-handicapped individuals;

wherein said first and second telephone instruments are each angularly mounted in a different one of the corners of said booth created by the junction of said backwall and said right sidewall and said backwall and said left sidewall.

2. The telephone enclosure of claim 1 wherein said backwall comprises soundproofing material.

3. The telephone enclosure of claim 1 wherein the space under said first telephone is free of obstructions.

4. The telephone enclosure of claim 1 wherein one of said left and right sidewalls comprises means for accepting an information containing panel.

5. The telephone enclosure of claim 4 wherein said information can be viewed from a location outside of said telephone enclosure.

6. The telephone enclosure of claim 4 wherein said panel comprises a compartment having a transparent window therein, said transparent window being movable to allow the insertion of visual materials therein.

* * * * *